US005806420A

United States Patent [19]

Erhard et al.

[11] Patent Number: 5,806,420

[45] Date of Patent: Sep. 15, 1998

[54] PRINTER FOR PRINTING COMPACT DISCS (CD)

[75] Inventors: Helmut Erhard, Volkach; Georg Schneider, Würzburg, both of Germany

[73] Assignee: Metronic - Geratebau GmbH & Co., Veitshochheim, Germany

[21] Appl. No.: 809,411

[22] PCT Filed: Oct. 19, 1995

[86] PCT No.: PCT/DE95/01459

§ 371 Date: Apr. 24, 1997

§ 102(e) Date: Apr. 24, 1997

[87] PCT Pub. No.: WO96/13386

PCT Pub. Date: May 9, 1996

[30] Foreign Application Priority Data

Oct. 26, 1994 [DE] Germany ..... 44 38 246.4

[51] Int. Cl.[6] ..... B41F 17/00

[52] U.S. Cl. ..... 101/37; 101/36; 101/479; 101/DIG. 35; 101/183; 101/216

[58] Field of Search ..... 101/479, DIG. 35, 101/35, 36, 37, 216, 183, 174

[56] References Cited

U.S. PATENT DOCUMENTS

| | | | |
|---|---|---|---|
| 1,782,608 | 11/1930 | Fulk | 101/479 |
| 4,449,450 | 5/1984 | Barny et al. | 101/216 |
| 4,939,992 | 7/1990 | Bird | 101/183 |
| 5,048,418 | 9/1991 | Hars et al. | 101/216 |
| 5,528,986 | 6/1996 | Andersson et al. | 101/219 |
| 5,676,053 | 10/1997 | Schafer | 101/141 |

FOREIGN PATENT DOCUMENTS

| | | |
|---|---|---|
| 0581378 | 7/1993 | European Pat. Off. . |
| 2938292 | 7/1981 | Germany . |
| 4328011 | 3/1994 | Germany . |
| 2192364 | 1/1988 | United Kingdom . |

*Primary Examiner*—Edgar S. Burr
*Assistant Examiner*—Daniel J. Colilla
*Attorney, Agent, or Firm*—Jones, Tullar & Cooper, P.C.

[57] ABSTRACT

A printing device for the printing of individual, flat print substrates, such as compact discs, in a multi-color print, uses a plurality of print units. These print units are arranged in a common frame and each has a print position. The distance between print positions in adjacent print units is less than the lengths or diameter of one of the print substrates.

12 Claims, 2 Drawing Sheets

PRINTER FOR PRINTING COMPACT DISCS (CD)

FIELD OF THE INVENTION

The present invention relates to a printing device for printing individual flat print substrates, preferably compact disks (CDs).

DESCRIPTION OF THE PRIOR ART

A device for multi-layer lacquering of sheet metal panels is known from DE 43 28 011 A1. Printing, in particular printing in good register, is not intended with this device and is also not possible. In addition, the distance between two directly adjoining lacquer application units is greater than the length of the sheet metal panels to be lacquered.

DE 29 38 291 B2 discloses a multi-color printing device for printing a flat plate, which is coated immediately thereafter. Multi-color printing is performed by flexographic printing, i.e. by a letter-press method. The pattern or plate cylinder is inked in several adjoining colors and its ink coating is transferred to a plate to be printed.

EP 0 581 378 A1 disclosed a printing device for printing individual flat print substrates, for example compact disks (CD) in multi-color print. The print substrates to be printed are fed by means of a feed device to a plurality of print units arranged after each other. The print positions of the plurality of print units have a distance from each other which is greater than the diameter or length of the print substrates. Short inking systems are known from EP 0 518 892 B1, for example.

SUMMARY OF THE INVENTION

The object of the present invention is directed to providing a printing device for multi-color printing of individual flat printed substrates, preferably of compact disks.

A printing device for printing individual, flat print substrates, such as compact disks or CD's, in multi-color print utilizes a feed device for the print substrate to be printed. A plurality of printing units are situated one after the other in the production direction, and receive the print substrates from the feed device. A delivery device for the print substrates receives the now printed substrates from the plurality of printing units. A distance between two print positions on two adjacent print units is less than the length or the diameter of a print substrate to be printed The advantages which can be obtained by the present invention consist in particular in that it is possible to employ the so-called planographic printing process without dampening agents with multi-color printing. The waste at start-up can be reduced, because so-called short inking units without color zones can be used. It is possible to print several lanes of compact disks simultaneously, wherein the pattern does not need to be the same. Support devices in the movement path of the print substrates between the print units can be omitted.

BRIEF DESCRIPTION OF THE DRAWINGS

An exemplary embodiment is represented in the drawings and will be described in detail below, in which.

DESCRIPTION OF THE PREFERRED EMBODIMENT

Figure 1:
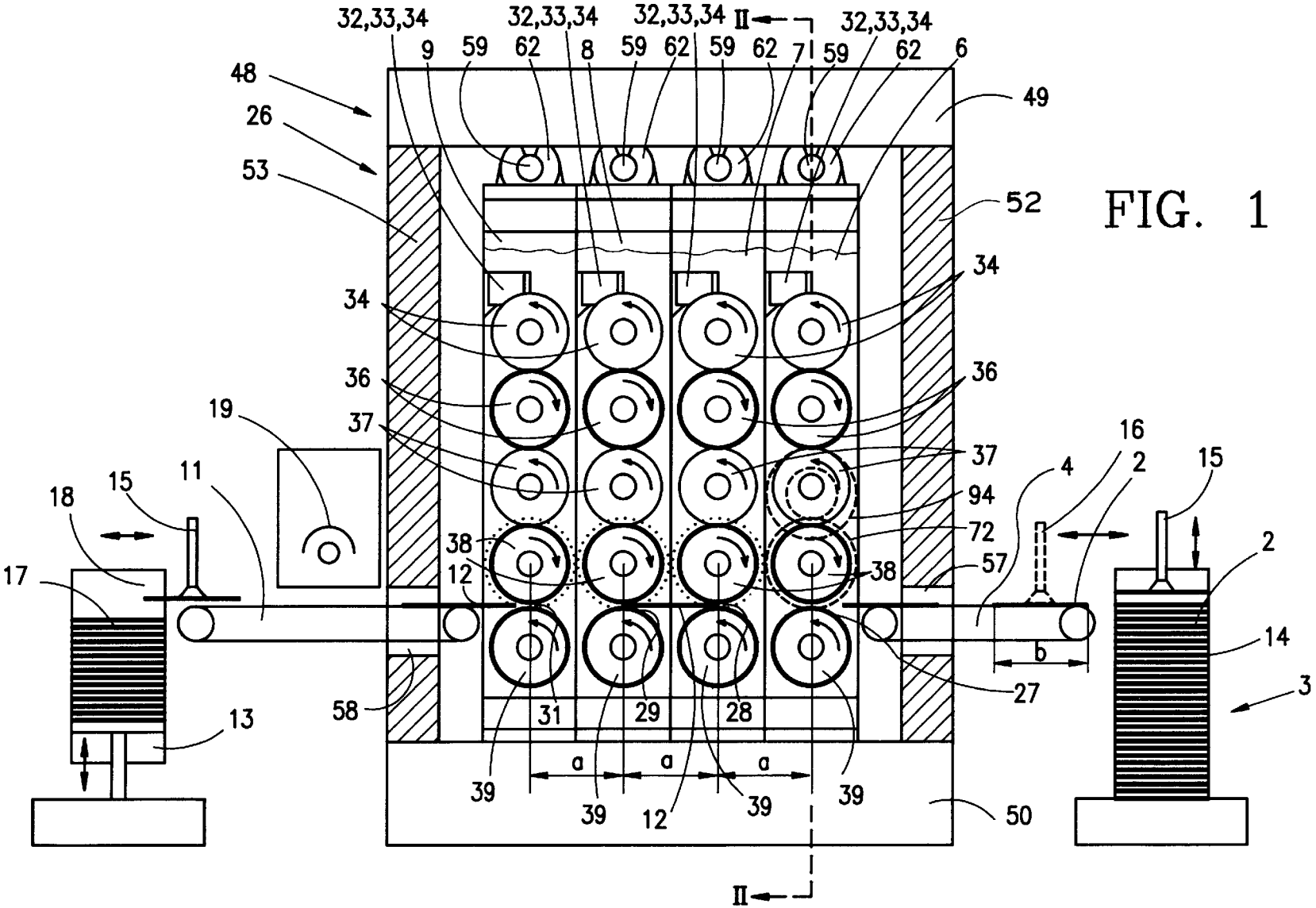
FIG. 1, is a front view of an exemplary embodiment of the printing device in accordance with the present invention in a schematic view.

The printing device 1 is used for printing plastic disks 2, in particular so-called compact disks, hereinafter called disks 2 for short. Viewed in the production direction, the printing device essentially consists of a separating device 3 for the stacked disks 2, a feed device 4 for conveying of the disks 2 to be printed from the separating device 3 to a first print unit 6, a plurality of, for example four, print units 6 to 9, and a conveying device 11 for conveying printed disks 12 to a delivery unit 13 for the printed disks 2.

Figure 2:
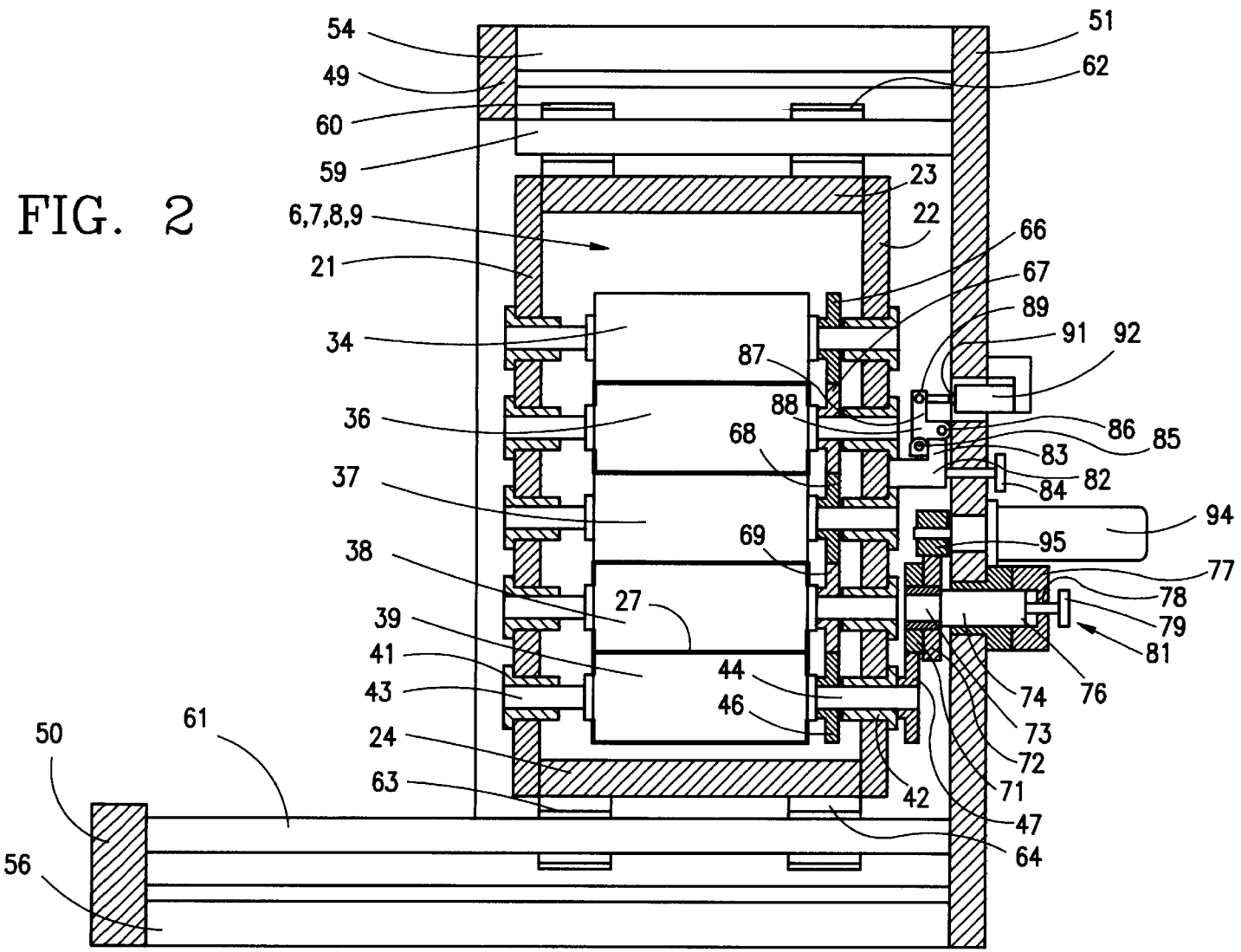
FIG. 2, is a section along the line II—II in FIG. 1.

Each of the print units 6 to 9 is preferably equipped for planographic printing without dampening agents using so-called UV inks and preferably does not have a unit for setting a print-zone-wide ink thickness, Each one of the four print units 6 to 9 has a left lateral wall 21 and a right lateral wall 22, as seen in FIG. 2 whose upper and lower ends are respectively bolted to an upper transverse plate 23 or a lower transverse plate 24 to form a print unit frame 26. Depending on the desired number of colors, the print units 6 to 9 can be lined up closely next to each other viewed in the production direction. This means that if two-color printing is desired, two print units 6, 7 are lined up next to each other, with four-color printing four print units 6 to 9 are situated next to each other.

In accordance with the present invention, a distance a, for example 100 mm, of the print positions 27 to 29 and 31 of respectively two directly adjoining print units 6/7 (27, 28) or 7/8 (28, 29) or print units 8/9 (29, 31), is respectively less than a diameter b, for example 120 mm, of each of the disks 2 to be printed. By means of this, it is assured that during their movement through the print units 6 to 9, the disks 2 are always fixedly clamped in at least one print positions 27 to 29, or 31 and therefore cannot move uncontrollably in a manner damaging the register. In this way, they are conveyed through the print units 6 to 9 with practically no slippage and are printed.

Each of the print units 6 to 9 consists of the frame 26 in which, viewed in the ink flow and vertical direction, the following are seated: an ink duct 32 with preferably one negative work doctor blade 33, a screen roller 34 against which the work doctor blade 33 is negatively set, an ink transfer roller 36, a printing plate support roller 37, supporting a printing plate which preferably is suitable for printing without a dampening agent, for example a so-called "waterless TORAY printing plate", a rubber blanket support roller 38 supporting a blanket, and a counter-pressure roller 39 with a rubber jacket. In the state where they are ready for printing, the rollers 34 to 39 all have the same diameter. However, the screen roller 34 can have twice, as well as half the diameter of the other rollers 36 to 39.

The ink duct 32 consists of a duct which is closed on five sides and which is used to contain the UV ink that the screen roller 34 dips into it. The work doctor blade 33 closes off the ink duct 32 on the bottom and is used for the even metering of the ink over the entire length of the screen roller 34, or a matched partial length, if several lanes of disks 2, situated next to each other, are intended to be printed.

The printing form is fastened on the printing plate support roller 37 in a known manner, for example by means of clamping or tensioning rails. The rubber blanket of the rubber blanket support roller 38 has been glued on it, for example.

The counter-pressure roller 39 is disposed directly underneath the rubber blanket support roller 38 and together with it constitutes a print position 27, 28, 29 or 31, each in the form of an adjustable print gap. In a manner which is itself known, the counter-pressure roller 39, for example, can be pivoted away from the rubber blanket support roller 38 by means of eccentric regulating devices 41, 42 for stopping the printing process. The eccentric regulating devices 41, 42 are embodied as eccentric bushings, which are seated, rotatable at the same time, in the left lateral wall 21 or the right lateral wall 22. A left axle journal 43 or a right axle journal 44 are rotatably seated in respectively one eccentric bore of the eccentric regulating device 41, 42. A spur-toothed gear wheel 46 is fastened, fixed against relative rotation, on the right axle journal 44 between the counter-pressure roller 39 and the right eccentric regulating device 42, and a respectively further spur-toothed gear wheel 47 is fastened in the same way on an end of the right axle journal 44 extending from the right lateral wall 22.

The screen roller 34, the ink transfer roller 36, the printing form support roller 37, the rubber blanket support roller 38 and the counter-pressure roller 39 are respectively seated on the lateral walls 21, 22. A spur-toothed gear wheel 66 to 69 and 47 is respectively fastened, fixed against relative rotation, on the right axle journals of these respective rollers, each between the roller body and the right lateral wall 22. The gear wheels 66 to 69 and 47 each have the same number of teeth and constitute a gear train. Power is applied to the gear wheel 47, as seen in FIG. 2.

Because of the "closely next to each other" arrangement and the small dimensions of the print units 6 to 9 in a frame 48, it would be practically impossible to come close to the rollers of the print units 6 to 9. The print units 6 to 9 are therefore preferably extensible on one side transversely to the production direction, wherein, uncoupled from their respective drives 71 and remaining in the frame 48, they can be pulled sufficiently far out until their rollers 36 to 39 are comfortably accessible.

All of the print units 6 to 9 are displaceably and lockably arranged in one printer frame 48 and each print unit 6 to 9 is situated generally perpendicularly with respect to the production direction. The printer frame 48 consists of an upper front plate 49, and upper rear plate 51, a right plate 52, a left plate 53, a top plate 54 and a bottom plate 56. The top plate 54 is approximately half as wide as the bottom plate 56. The right plate 52 and the left plate 53 each have respectively at the height of the print positions 27 and 31 a sufficiently high and wide inlet or outlet opening 57 or 58 for feeding disks 2 to be printed to the first print unit 6, or for removing printed disks 12 from the last print unit 9.

The printer frame 48 is open at the front and the top plate 54 covers the bottom plate 56 only over half its depth. An upper guide rod 59 or a lower guide rod 61 with respectively a "key hole diameter-like" diameter per print unit 6 to 9 is provided between the front plate 49 and the rear plate 51, fastened "suspended" from the top plate 54 or fastened standing on the bottom plate 56. The upper guide rod 59 is used for guiding an upper front guide element 60 and an upper rear guide element 62. The lower guide rod 61 is used for guiding a lower front guide element 63 and a lower rear guide element 64. The guide elements 60, and 62 to 64 respectively each have two half-shells which grasp around the cylindrical part of the guide rods 59 or 61. The upper guide elements 60 and 62 are fastened "standing" on the upper transverse plate 23, the lower guide elements 63 and 64 are fastened "suspended" from the underside of the lower transverse plate 24. The guide rods 58 and 61 and the guide elements 60 and 62 to 64 respectively constitute a sliding guide, wherein the half-shells of the guide elements 60 and 62 to 64 are matched to the portion of the guide rods 59 and 61 with the round cross section.

The displacement path of the print units 6 to 9 is laid out in such a way that the print units 6 to 9 can be individually pulled forward out of their work position to a position where their rollers can be manipulated. Because of this, the respective print unit gear wheel 47 comes out of engagement with the teeth of a spur-toothed drive gear wheel 71, which forms the respective drive for the print units 6 to 9. The print unit gear wheel 47 is half as wide as the drive gear wheel 71. The gear wheel 71, together with a helically-toothed gear wheel 72, is rotatably seated on a first journal end 73 of a journal 74 extending into the housing. The gear wheels 71 and 72 are connected, fixed against relative rotation, with each other. The journal 74 is seated, fixed against relative rotation but horizontally displaceable along its longitudinal axis, in the rear plate 51. A second journal end 76 extending from the rear plate 51 terminates in a cup 77 fastened to the exterior of the rear plate 51. A threaded bore has been cut into a front face 78 of the cup 77, which is engaged by the thread of a regulating screw 79. One end of the regulating screw 79 is connected interlockingly rotatable with the front of the journal end 76. The elements 72 to 79 are components of a circumferential register adjusting device 81 provided for each print unit 6 to 9.

An arresting angle element 82 with unequal legs is fastened between the roller journal ends of the ink transfer roller 36 and the printing form support roller 37 on the outside of the right lateral wall 22. Its short leg 83 points upward. A thread of a regulating screw 84 for setting a side register is in engagement with a threaded bore in the right plate 51. One end of the regulating screw 84 is in touch with a vertical front face of the arresting angle element 82. Slightly above a front face of the short leg 83, a seating angle 86 with a bearing bore is screwed to the inside of the right plate 51. A double-armed arresting lever 87 is pivotably and drivably seated on the seating angle element 86. In the locked state, an end of a first lever arm 88, provided with a roller 85, of the arresting lever 87, pushes the arresting angle element 82 against the regulating screw 84 by means of the roller 85. An end of the second lever arm 89 of the arresting lever 87 is pivotably connected with an end of a piston rod 91 of a double-acting pneumatic cylinder 92. The pneumatic cylinder 92 is supported on the right plate 51. If the piston rod 91 of the pneumatic cylinder 92 is extended, the respective print unit 6 to 9 is arrested, while keeping the registration, via the roller 85 on the rear plate 51. If the piston rod 91 is retracted, the arresting lever 87 is pivoted in such a way that the roller 85 has released the leg 83 and in this way the selectively unlocked print unit 6 to 9 is released and can be pulled out.

The helically-toothed gear wheels 72 of the print units 6 to 9 are always in engagement. The power supply for the printing device is provided, for example, via a toothed belt pulley 95, which is connected, fixed against relative rotation, with the gear wheel 72 of the last print unit 9. An rpm-controlled d.c motor or 94 is provided as the drive unit, whose output, by means of a toothed belt, drives the toothed-belt pulley 95 flanged to the gear wheel 72.

The separating device 3 can be embodied similar to a sheet feeder of a sheet-fed rotary printing press, but of course much smaller. The stacked disks 2, which are to be printed, are lifted off a follow-up stack 14 by means of a horizontally and vertically movable suction lifter 15 in the print rhythm, placed on the feed device 4, such as a conveyor belt, and conveyed to the first print position 27. The disks 2 or 12 are grasped in the print positions 27, 28, 29 and 31 by the rubber blanket support roller 37 and the counter-pressure roller 39 and, while being printed, are conveyed by them to the next print unit 7 to 9 or deposited from the last print unit 9 to a conveyor belt of the conveying device 11. In the course of their conveyance on the feed device 4, the disks 2 are respectively aligned in the longitudinal and transverse direction by means of a device, not represented, so that they are correctly aligned and are pushed in the printing cycle into the first print position 27 and are then conveyed on. From there, the disks 12, which are clamped in the respective previous print position 27, 28, 29 and 31, reach the respectively next print position 28, 29 or 31. By means of this, it is assured that the exact register is maintained during the transfer from print unit to print unit.

The printed disks 12 are lifted off the conveyor belt or conveyor belts of the conveying device 11 by means of a print-cycle-controlled suction lifter 16 and are deposited on an output stack 17 of an output stacking device 18. On their way from the last print unit 9 to the output stack 17, the disks 12, printed by means of UV ink, pass through the drying section of a UV dryer 19.

We claim:

1. A printing device for printing individual flat compact disks, each of the compact disks having a first length, said device comprising:

a plurality of print units including at least first and last print units arranged adjacent each other in a production direction, each of said plurality of print units having a print position, each of said print positions being spaced from adjacent ones of said print positions by a second length, said second length being less than said first length;

a feed device for feeding the compact disks to said first one of said plurality of print units and for supporting the compact disks to be printed until each is engaged in said print position of said first one of said plurality of print units, each of the compact disks being supported solely by said plurality of print units during passage of each of the compact disks through said plurality of print units; and a delivery device for receiving the printed compact disks from said last one of said plurality of print units.

2. The device of claim 1 wherein each of said plurality of print units includes a short inking system including a screen roller and a cooperating ink transfer roller.

3. The device of claim 2 wherein said short inking system further includes an ink duct and a work doctor blade, said screen roller dipping into said ink duct, said work doctor blade being set against said screen roller.

4. The device of claim 1 wherein each of said plurality of print units includes a counter-pressure roller provided with an elastic jacket.

5. The device of claim 1 further including a device for setting lateral register associated with each of said print units.

6. The device of claim 1 further including a device for setting circumferential register associated with each of said print units.

7. The device of claim 1 further including a frame, all of said plurality of print units being situated in said frame.

8. The device of claim 7 further including upper and lower guides in said frame, said print units being arranged displaceable transversely to said production direction in said upper and lower guides.

9. The device of claim 1 wherein each of said plurality of print units uses UV dryable ink.

10. The device of claim 1 further including a UV dryer positioned between said last one of said plurality of print units and said delivery device.

11. The device of claim 2 wherein said short inking system for each of said plurality of print units is located above its associated one of said plurality of print units.

12. The device of claim 2 wherein ink from said short inking system for each of said plurality of print units flows in a vertical downward direction.

* * * * *